US005557936A

United States Patent [19]

Drnevich

[11] Patent Number: 5,557,936

[45] Date of Patent: Sep. 24, 1996

[54] THERMODYNAMIC POWER GENERATION SYSTEM EMPLOYING A THREE COMPONENT WORKING FLUID

[75] Inventor: Raymond F. Drnevich, Clarence Center, N.Y.

[73] Assignee: Praxair Technology, Inc., Danbury, Conn.

[21] Appl. No.: 508,568

[22] Filed: Jul. 27, 1995

[51] Int. Cl.[6] ..... F01K 25/06

[52] U.S. Cl. ..... 60/649; 60/651; 252/67; 252/69

[58] Field of Search ..... 60/649, 651, 671, 60/673; 252/67, 69

[56] References Cited

U.S. PATENT DOCUMENTS

| | | | |
|---|---|---|---|
| 2,248,178 | 7/1941 | Kuenzli | 252/69 |
| 4,346,561 | 8/1982 | Kalina | 60/673 |
| 4,489,563 | 12/1984 | Kalina | 60/673 |
| 4,548,043 | 10/1985 | Kalina | 60/673 |
| 5,077,030 | 12/1991 | Yogev | 60/649 |

OTHER PUBLICATIONS

"Integrated Sensors For Process Control", *Mechanical Engineering*, vol. 114/No. 9, Sep. 1992 pp. 75–81.

"A Kalina Cycle Application For Power Generation", *Energy*, vol. 18, No. 9 pp. 961–969, 1993. M. Ibrahim & R. Kovach.

"New Thermodynamic Concept Shows Promise", *Power Engineering*, p. 1, R. Smock, Jun. 1993.

"Innovative Kalina Cycle Promises High Efficiency", *Power*, N. G. Zervos et al., Apr. 1992, pp. 177–179.

"Operating Experiences On The 3MW Kalina Cycle Demonstration Plant", H. M. Leibowitz, *American Power Conference*, pp. 173–178.

"Kalina Bottoming Cycle 3.2–MW Demo Plant Rated 29.6% Efficiency", I. Stambler, *Gas–Turbine World*, Mar.–Apr. 1992, pp. 24–27.

"Kalina Cycles: Some Possible Applications And Comments", *American Power Conference*, S. Stecco, pp. 196–202.

"Gas Turbine Bottoming Cycles: Triple Pressure Stream VS. Kalina", *American Power Conference*, C. Marston et al., pp. 185–190.

"Updated Design And Economics Of The Kalina Cycle For Solid Fuel Applications", *American Power Conference*, N. G. Zervos, pp. 179–184.

"A Low–Tech Scheme To Give Steam Turbines More Power", *Business Week*, Nov. 28, 1983, p. 126 D, F.

"A Kalina Cycle Technology And Its Applications", Dr. Kalina, *A.I.C.h.E*, Apr. 1986.

"From Russia, With Patents", J. Norman, *Forbes*, Apr. 12, 1993, pp. 112, 113.

*Primary Examiner*—Leonard E. Heyman
*Attorney, Agent, or Firm*—Stanley Ktorides

[57] ABSTRACT

A system for generating power as a result of an expansion of a pressurized working fluid through a turbine exhibits improved efficiency as the result of employing a tri-component working fluid that comprises water, ammonia and carbon dioxide. The pH of the working fluid is maintained within a range to prevent precipitation of carbon-bearing solids (preferably between 8.0 to 10.6). The working fluid enables an efficiency improvement in the Rankine cycle of up to 12 percent and an efficiency improvement in the Kalina cycle of approximately 5 percent.

8 Claims, 4 Drawing Sheets

EQUILIBRIA IN THE SYSTEM $NH_3$-- $CO_2$-- $H_2O$

THERMODYNAMIC POWER GENERATION SYSTEM EMPLOYING A THREE COMPONENT WORKING FLUID

FIELD OF THE INVENTION

This invention relates to thermodynamic power generation cycles and, more particularly, is a thermodynamic power generation system which employs a working fluid comprising water, ammonia and carbon dioxide.

BACKGROUND OF THE INVENTION

The most commonly employed thermodynamic power generation cycle for producing useful energy from a heat source is the Rankine cycle. In the Rankine cycle, a working fluid, such as water, ammonia or freon is evaporated in an evaporator using an available heat source. Evaporated gaseous working fluid is then expanded across a turbine to release energy. The spent gaseous working fluid is then condensed using an available cooling medium and the pressure of the condensed working fluid is increased by pumping. The compressed working fluid is then evaporated and the process continues.

In FIGS. 1 and 2, thermodynamic power generation systems are shown which employ steam and ammonia/water working fluids, respectively. In FIG. 1, the thermodynamic power apparatus includes an inlet 10 wherein superheated air is applied to a series of heat exchangers 12, 14 and 16. Air is exhausted from heat exchanger 16 via outlet 18. Air streams flowing between inlet 10 and the respective heat exchangers are denoted A, B, C and D. The working fluid in the system of FIG. 1 is water/steam, with the water being initially pressurized by pump 20 and applied as stream E to heat exchanger 16 where it is heated to a temperature near its initial boiling point. The hot water emerges from heat exchanger 16 via stream F and is applied to heat exchanger 14 where it is converted to steam and, from there via stream G, to heat exchanger 12 where it emerges as super heated steam (stream H). The super heated steam is passed to expander/turbine 22 where power generation work occurs. The exiting water/steam mixture from expander turbine 22 is passed to condenser 24 and the cycle repeats.

In the example shown in FIG. 1, the temperature of the gas at inlet 10 is 800° F. The heat extracted from the inlet gas in heat exchanger 12 superheats saturated steam in stream G to produce the superheated steam of stream H. Turbine 22 produces 2004 horsepower of shaft work which is converted into electricity or used to drive a compressor or other mechanical device. The partially condensed steam, as above indicated, is completely condensed in condenser 24 and pump 20 raises the pressure of liquid water from 1 pound per square inch absolute (psia) to 600 psia prior to its entry into heat exchanger 16. The air exiting heat exchanger 16 is at 374° F. This temperature is limited by the pinch point temperature in heat exchanger 14. That temperature is the difference in temperature between the air exiting heat exchanger 14 (at 506° F.) and the saturated water entering heat exchanger 14 (at 484° F.) i.e., a temperature difference of 22° F. That temperature is a function of water pressure and gas and water flow rates. Table 1 below shows the results of calculations in a case study for the conditions shown in FIG. 1.

TABLE 1

| Stream | A | B | C | D | E | F | G | H | I | J |
|---|---|---|---|---|---|---|---|---|---|---|
| Molar flow (lbmol/h) | 5000 | 5000 | 5000 | 5000 | 650 | 650 | 650 | 650 | 650 | 650 |
| Mass flow (lb/h) | 144289 | 144289 | 144289 | 144289 | 11709 | 11709 | 11709 | 11709 | 11709 | 11709 |
| Temp (°F.) | 800 | 740 | 505 | 374 | 104 | 484 | 483 | 770 | 102 | 102 |
| Pres (psia) | 15 | 14.9 | 14.89 | 14.88 | 600 | 590 | 580 | 578 | 1.0 | 1.0 |

FIG. 2 is a repeat of the system of FIG. 1, wherein the working fluid is an ammonia/water mixture. Each of the elements shown in FIG. 1 is identically numbered with that shown in FIG. 1. The temperatures and pressures, however, have been modified in accordance with a recalculation of the thermodynamic properties of the ammonia/water working fluid. The mole fraction of ammonia in the working fluid mixture is 0.15. The pressure of stream I is increased to 6.5 psia to permit the working fluid to be completely condensed at 102° F. prior to entering pump 20. The net result of the increase in pressure at condenser 24 is a reduction in turbine power of turbine 22 to 1840 horsepower from 2004 horsepower in the steam system in FIG. 1. This reduction occurs even though more energy is removed from the air stream through use of the water/ammonia working fluid. The temperature of the air at exit 18 is 318° F. versus 374° F. for the air at exit 18 in FIG. 1.

Table 2 below illustrates the calculated parameters that were derived for the ammonia/water working fluid system of FIG. 2.

TABLE 2

| Stream | A | B | C | D | E | F | G | H | I | J |
|---|---|---|---|---|---|---|---|---|---|---|
| Molar flow (lbmol/h) | 4998 | 4998 | 4998 | 4998 | 746 | 750 | 750 | 750 | 750 | 750 |
| Mass flow (lb/h) | 144202 | 144202 | 144202 | 144202 | 13346 | 13346 | 13346 | 13346 | 13346 | 13346 |
| Temp (°F.) | 800 | 732 | 469.9 | 318.2 | 104 | 437 | 471 | 770 | 166 | 102 |
| Pres (psia) | 15.0 | 14.9 | 14.89 | 14.88 | 600 | 590 | 580 | 578 | 6.51 | 6.51 |

The above prior art examples of the Rankine cycle using both steam and ammonia/water working fluids indicate that the addition of the ammonia to the water substantially decreases the efficiency of the thermodynamic cycle.

A recently developed thermodynamic power generation system which exhibits improved efficiency over the Rankine cycle is the Kalina cycle. FIG. 3 illustrates a simplified schematic diagram of the major components of a power generation system that employs a Kalina cycle and further utilizes a water/ammonia working fluid. While details of power generation systems using the Kalina cycle can be found in U.S. Pat. Nos. 4,346,561, 4,489,563 and 4,548,043, all to A. I. Kalina, a brief description of the system of FIG. 3 is presented here.

The water/ammonia working fluid is pumped by pump 30 to a high working pressure (stream A). Stream A is an ammonia/water mixture, typically with about 70–95 mole percent of the mixture being ammonia. The mixture is at sufficient pressure that it is in the liquid state. Heat from an available source, such as the exhaust gas from a gas turbine, is fed via stream B to an evaporator 32 where it causes the liquid of stream A to be converted into a superheated vapor (stream C). This vapor is fed to expansion turbine 34 which produces shaft horsepower that is converted into electricity by a generator 36. Generator 36 may be replaced by a compressor or other power consuming device.

The outlet from expansion turbine 34 is a low pressure mixture (stream D) which is combined with a lean ammonia liquid flowing as stream E from the bottom of a separation unit 38. The combined streams produce stream F which is fed to condenser 40. Streams E and F are typically about 35 mole percent and 45 mole percent ammonia, respectively.

Stream F is condensed in condenser 40, typically against cooling water that flows in as stream G. The relatively low concentration of ammonia in stream F, as compared to stream D, permits condensation of the vapor present in stream D at much lower pressure than is possible if stream D were condensed prior to the mixing as in the case of the Rankine cycle. The net result is a larger pressure ratio between streams C and D which translates into greater output power from expansion turbine 34. Separation unit 38 typically carries out a distillation type process and produces the high ammonia content stream A that is sent to evaporator 32, and the low concentration stream E that facilitates absorption/condensation of the gases in stream D.

While the Kalina cycle exhibits potentially higher levels of power generation efficiency than the Rankine cycle, present-day power installations almost universally employ equipment which utilizes the Rankine cycle. Nevertheless, with both thermodynamic power generation cycles, cost-effective improvements to their efficiency have a dramatic affect on the cost of the output power. Further, to the extent that such improvements can be utilized without major changes in capital equipment, such changes will likely be rapidly implemented.

Accordingly, it is an object of this invention to provide a means for improving the efficiency of both Rankine and Kalina cycle thermodynamic power generation systems.

It is another object of this invention to provide an improvement to present-day thermodynamic power generation systems, which improvement may be implemented without expenditure of large capital investments.

SUMMARY OF THE INVENTION

A system for generating power as a result of an expansion of a pressurized fluid through a turbine exhibits improved efficiency as the result of employing a three-component working fluid that comprises water, ammonia and carbon dioxide. Preferably, the pH of the working fluid is maintained within a range to prevent precipitation of carbon-bearing solids (i.e., between 8.0 to 10.6). The working fluid enables an efficiency improvement in the Rankine cycle of up to 12 percent and an efficiency improvement in the Kalina cycle of approximately 5 percent.

DETAILED DESCRIPTION OF THE INVENTION

The essence of this invention is the use in a thermodynamic power generation cycle of a working fluid that is a mixture of carbon dioxide, ammonia and water in the vapor phase. This results in a mixture of $NH_3$, $NH_4^+$, $OH^-$, $H^+$, $CO_2$, $H_2$, $CO_3$, $HCO_3^-$, $CO3^{-2}$ and $NH_2CO_2^-$ in water (in the liquid phase). This working fluid mixture increases the efficiency of power generation and/or reduces the cost of equipment used in the power generation. At low temperatures, e.g. around 100° F., the liquid phase components form a solution that is highly soluble in water. As the temperature increases, the liquid phase species decompose to form water, ammonia and carbon dioxide. This tri-component fluid mixture permits more effective use of low level energy to vaporize the mixture in either a Rankine cycle or to produce a high volume vapor stream in a Kalina cycle.

The addition of ammonia to water decreases the temperature at which the mixture boils and condenses. The Kalina cycle employs absorption and distillation to improve efficiency. Addition of carbon dioxide to the ammonia/water mixture results in the formation of ionic species that allow complete condensation of the fluid at higher temperatures than when the working fluid comprises ammonia and water alone. The addition of carbon dioxide further allows for the formation of a vapor phase at lower temperatures than with a working fluid of ammonia and water alone. Consequently, more low-level (low quality) heat is used for vaporization of the working fluid and this permits the high level heat to be used for superheating the vapor. The higher effective superheat level combined with the lower condenser pressure (higher condensation temperature) results in more power output from a given heat source.

Figure 4:
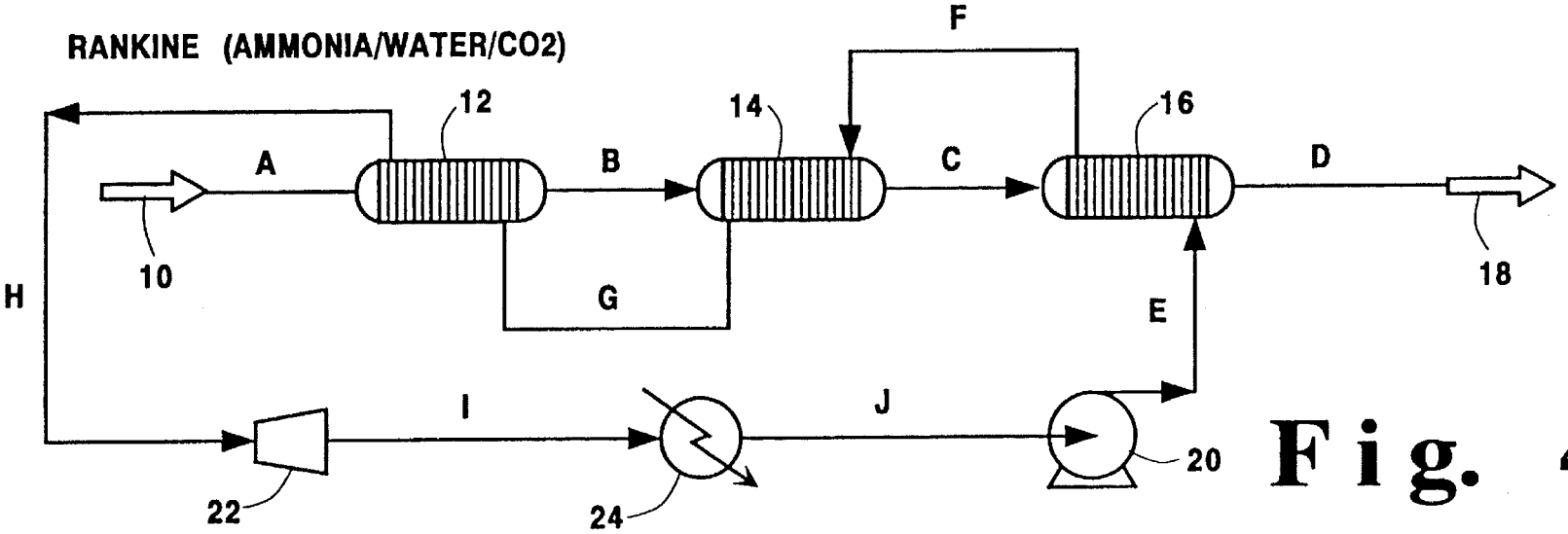
FIG. 4 is a schematic representation of an embodiment of the invention which employs the Rankine cycle and a working fluid comprising ammonia, water and carbon dioxide.

FIG. 4 shows the impact of adding carbon dioxide to the ammonia/water mixture. The mole fraction of ammonia plus carbon dioxide in the working fluid is 0.15 (ammonia at 0.10 and carbon dioxide at 0.05). Table 3 illustrates the calculated parameters that were derived for the ammonia/water/carbon dioxide working fluid embodiment of the invention illustrated in FIG. 4.

TABLE 3

| Stream | A | B | C | D | E | F | G | H | I | J |
|---|---|---|---|---|---|---|---|---|---|---|
| Molar flow (lbmol/h) | 5000 | 5000 | 5000 | 5000 | 697 | 697 | 697 | 697 | 697 | 697 |
| Mass flow (lb/h) | 144289 | 144289 | 144289 | 144289 | 13393 | 13393 | 13393 | 13393 | 13393 | 13393 |
| Temp (°F.) | 800.0 | 735 | 392 | 312 | 105 | 286 | 466 | 770 | 119 | 102 |
| Pres (psia) | 1500 | 14.90 | 14.89 | 14.88 | 600 | 590 | 580 | 578 | 2 | 2 |

The pressure of stream I is decreased to 2 psia as a result of the working fluid composition. The net result of the decrease in pressure in stream I is an increase in power output from turbine 22 to 2028 HP. As compared with the steam system shown in FIG. 1, the power increase from 2004 HP to 2028 HP represents an increase in efficiency of 1.2 percent. As compared to the ammonia/water working fluid system shown in FIG. 2, the change in efficiency from 1840 HP to 2028 HP is approximately 9.3 percent. The increased efficiencies occur without increasing the quantity of energy removed from the air stream introduced at inlet 10.

Figure 2:
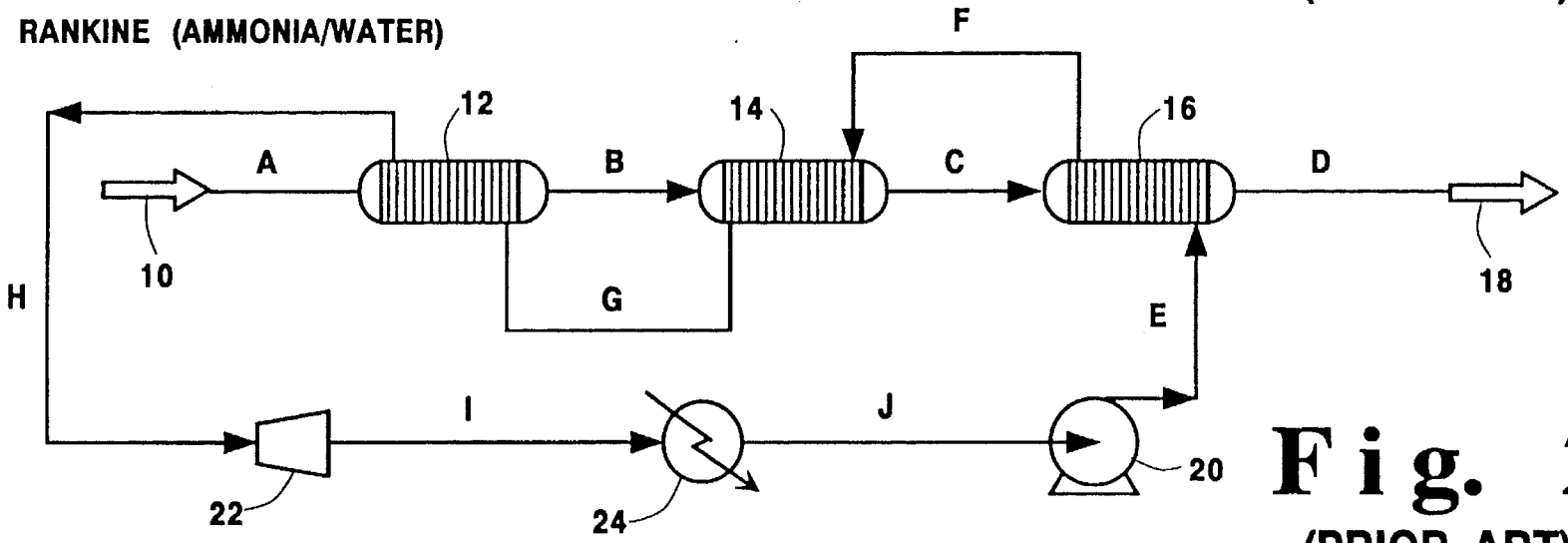
Fig. 2 (PRIOR ART)
FIG. 2 is a schematic representation of a prior art power generation system employing a Rankine cycle using a working fluid of ammonia and water.

FIG. 2 shows a pinch temperature between streams F and C of 33° F. whereas the system of the invention employing the tri-component working fluid shows a pinch temperature of 106° F., indicating that substantially less heat exchange area is required. This reduces the equipment cost while increasing the system's efficiency.

Figure 5:
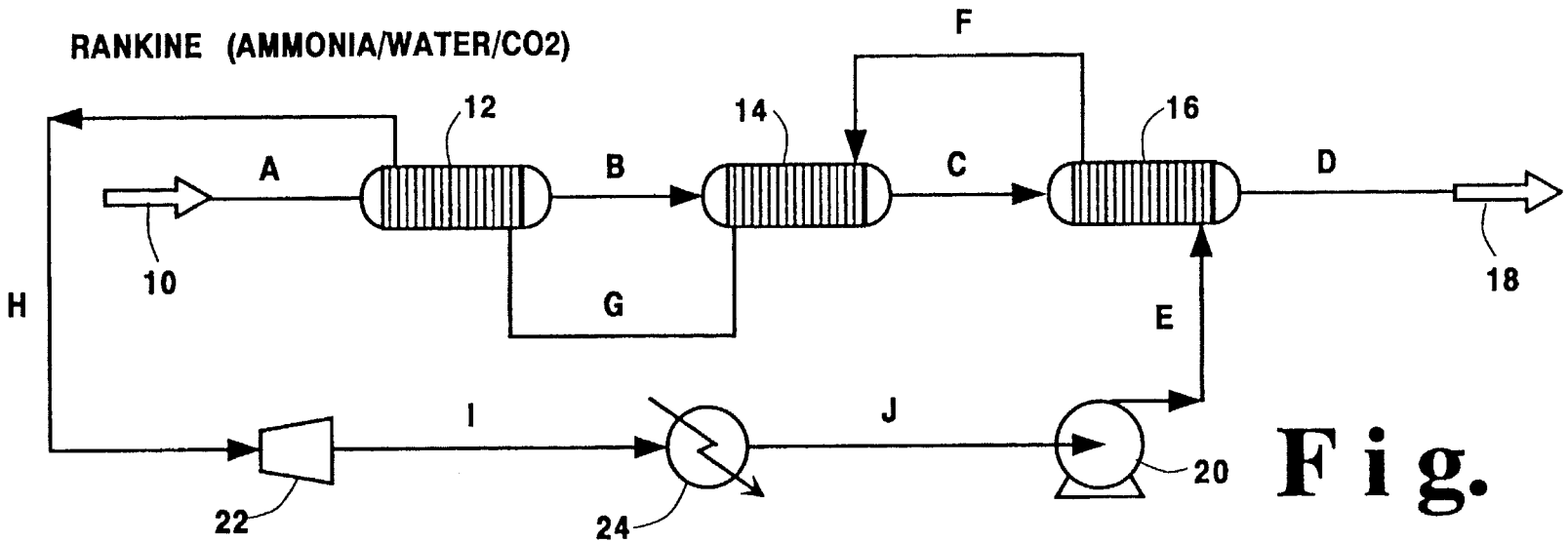
FIG. 5 is a schematic representation of the embodiment of the invention shown in FIG. 4 wherein a further improvement is manifest by reduction of a pinch temperature in a heat exchanger system.

In FIG. 5, the system of FIG. 4 has been modified to show a further improvement in performance of a system employing the tri-component working fluid. Calculated parameters for the system of FIG. 5 are illustrated in Table 4 below.

TABLE 4

| Stream | A | B | C | D | E | F | G | H | I | J |
|---|---|---|---|---|---|---|---|---|---|---|
| Molar flow (lbmol/h) | 5000 | 5000 | 5000 | 5000 | 760 | 760 | 760 | 760 | 760 | 760 |
| Mass flow (lb/h) | 144289 | 144289 | 144289 | 144289 | 14604 | 14604 | 14604 | 14604 | 14604 | 14604 |
| Temp (°F.) | 800.00 | 731 | 357 | 268 | 105 | 292 | 482 | 678 | 119 | 102 |
| Pres (psia) | 15 | 14.9 | 14.89 | 14.9 | 700 | 690 | 680 | 678 | 2 | 2 |

Figure 1:
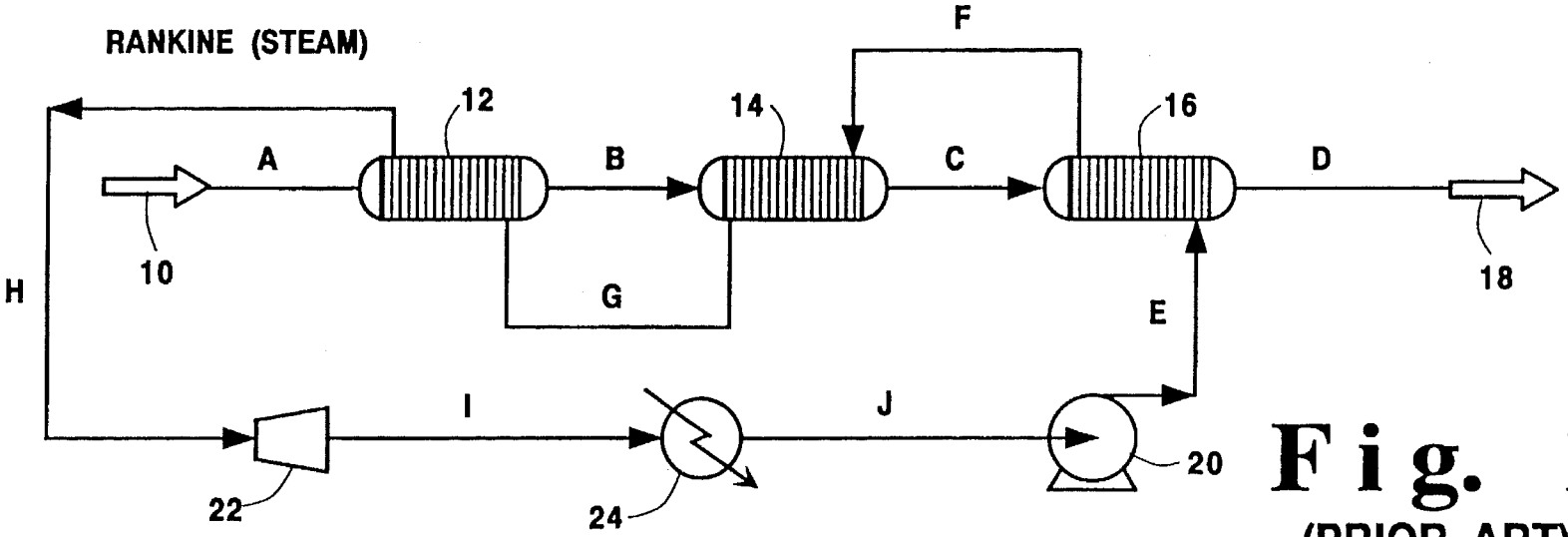
Fig. 1 (PRIOR ART)
FIG. 1 is a schematic representation of a prior art Rankine cycle power generation system employing steam.

By reducing the pinch temperature between stream F (292° F.) and stream C (357° F.) to a differential of 65° F., more low level heat is used to vaporize the tri-component mixture. The fluid pressure leaving pump 20 (stream E) is increased to 700 psia so that the temperature of stream G (482° F.) is the same as the temperature of stream G as shown in FIG. 1, wherein only steam is used as the working fluid. The net effect of these changes increases the output of turbine 22 to 2,250 horsepower, an approximately 11 percent increase in turbine output. The difference in pinch temperature between the systems of FIG. 1 and FIG. 5 (22° F. versus 65° F.) illustrates the potential for the reduction of equipment cost.

Figure 3:
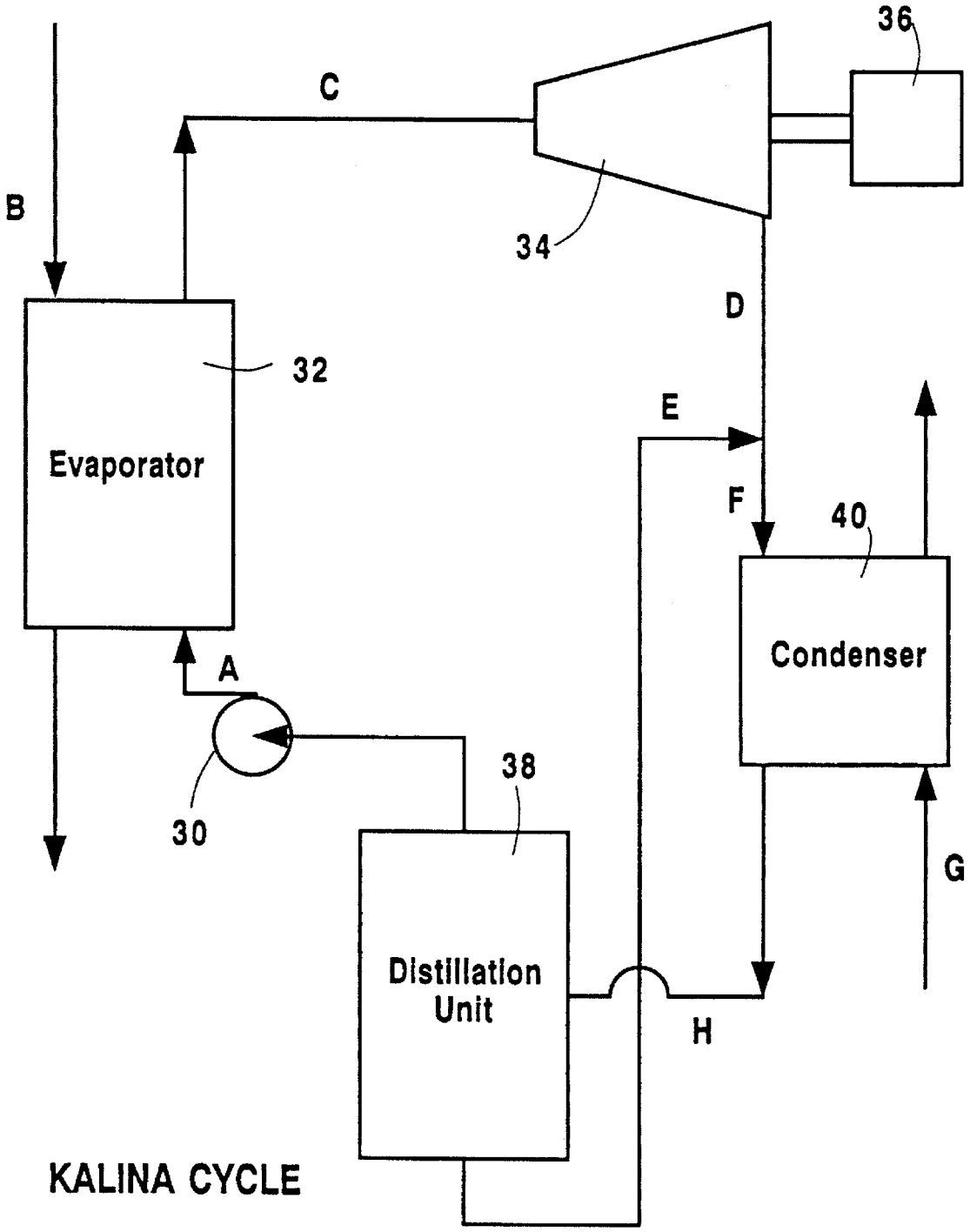
Fig. 3 (Prior Art)
FIG. 3 is a schematic representation of a prior art Kalina cycle system employing a water/ammonia Working fluid.

Applying the tri-component working fluid of the invention to the Kalina cycle of FIG. 3 involves the composition of water, ammonia and carbon dioxide in stream F (including all ionic species associated with the liquid phase). It is preferred that the ammonia plus carbon dioxide content of stream F be the same as the conventional ammonia-based Kalina cycle (approximately 45 mole percent). The relative ammonia/carbon dioxide concentration is preferably set so that the pH of stream H is maintained in a range of 8.0 to 10.6. In this pH range, the minimum condensation pressure is obtained for stream F resulting in a minimum discharge pressure for expansion turbine 34 (i.e., maximum power output).

A stream containing about 45 mole percent ammonia in water requires an expansion turbine exhaust pressure in excess of 35.5 psia, if the condensate (stream H) is at 102° F. If the condensate stream H contains 29 mole percent ammonia and 16 mole percent carbon dioxide in water, the exhaust pressure of expansion turbine 34 can be reduced approximately 2.4 psia at 102° F. The result of this lower condenser pressure is that the tri-component fluid system is capable of efficiencies that are at least 5 percent higher than those achievable using an ammonia/water based Kalina cycle.

Figure 6:
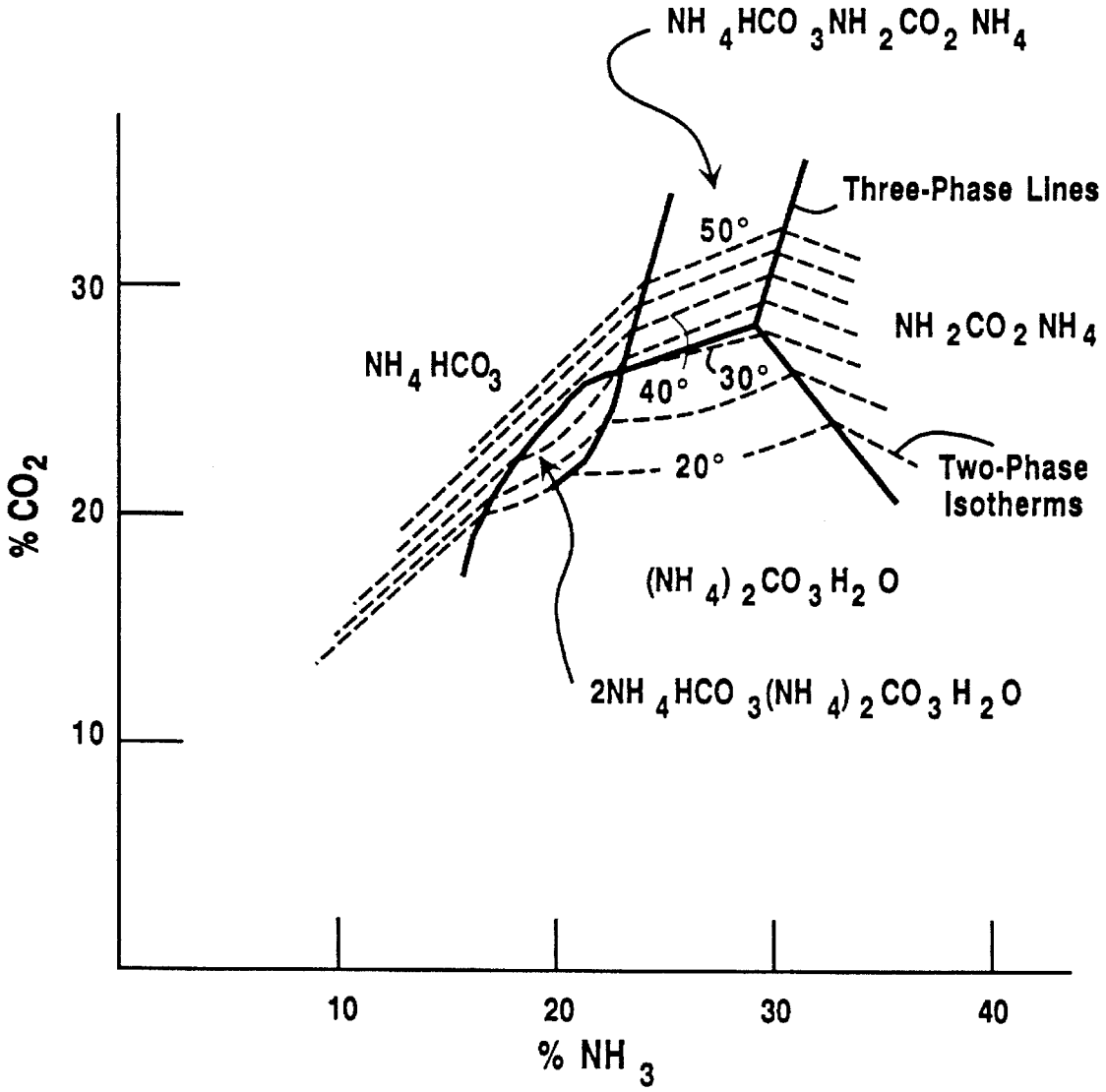
FIG. 6 is a plot of percentage of carbon dioxide versus equilibria in the system $NH_3$—$CO_2$—$H_2O$ showing both two phase and three phase isotherms.

The composition of stream F preferably should be controlled to the point where precipitation of carbonates, bicarbonates, carbamates and other ammonia carbonate solids is avoided. In FIG. 6, a plot of percentage $CO_2$ to equilibria in the system $NH_3$—$CO_2$—$H_2O$ is illustrated. The concentrations are in mole percent and the temperatures are in ° C. If the system is adjusted to operate below the two-phase isotherms, formations of the solid phase are avoided.

Some advantage may be obtainable if stream F in FIG. 3 and stream J in FIG. 5 are maintained at pH levels below 8.0 or above 10.6. However, little or no advantage is gained if these streams are operated at pH levels below 7.5 or above 12, unless the formation of precipitates is acceptable to operation of the system components. At low pH levels, it is difficult to achieve high ammonia content without precipitating species such as $NH_4HCO_3$. At high pH levels, it is difficult to obtain high $CO_2/NH_3$ ratios without forming precipitates such as $NH_2CO_2NH_4$.

There may be situations where precipitation of solids in a condenser system may be desired. Since ammonium-carbonate precipitates generally decompose at low temperatures, forming precipitates in the condenser may make it possible to more efficiently use low level heat. However, by avoiding precipitate formations, equipment problems such as condenser and heat exchanger plugging, pump erosion and fouling in the separation unit are avoided.

It should be understood that the foregoing description is only illustrative of the invention. Various alternatives and modifications can be devised by those skilled in the art without departing from the invention (e.g., such as dual pressure and reheat Rankine cycles). Accordingly, the present invention is intended to embrace all such alternatives, modifications and variances which fall within the scope of the appended claims.

What is claimed is:

1. A method for generating power comprising the steps of providing a pressurized working fluid comprising water, ammonia, and carbon dioxide, and expanding the pressurized working fluid in a turbine to generate useful power.

2. The method as recited in claim 1 wherein said ammonia and carbon dioxide are present in said water in a ratio which establishes a pH for said working fluid within a range of from 7.5 to 12.

3. The method as recited in claim 1 wherein said ammonia and carbon dioxide are present in said water in a ratio which establishes a pH for said working fluid within a range of from 8.0 to 10.6.

4. The method as recited in claim 1 wherein said working fluid is subjected to a Rankine thermodynamic power generation cycle.

5. The method as recited in claim 1 wherein said working fluid is subjected to a Kalina thermodynamic power generation cycle.

6. The method as recited in claim 5 wherein the ammonia and carbon dioxide content of said working fluid is about 45 mole percent.

7. The method as recited in claim 6 wherein the concentration of ammonia and carbon dioxide in water is set so that a pH of said working fluid in a liquid state is maintained within a range of from 8.0 to 10.6.

8. The method as recited in claim 6 wherein the concentration of ammonia and carbon dioxide in water is set so that a pH of said working fluid in a liquid state is maintained within a range of from 7.5 to 12.0.

* * * * *